US005220866A

United States Patent [19]

Mason, Jr. et al.

[11] Patent Number: 5,220,866

[45] Date of Patent: Jun. 22, 1993

[54] TRASH AND GARBAGE COMPACTING SYSTEMS

[76] Inventors: Stanley I. Mason, Jr., 61 River Rd.; Michael D. Handler, 496 Newtown Turnpike, both of Weston, Conn. 06883; Scott D. Salmon, 206 Hillcrest Ave., Leonia, N.J. 07605; Peter L. Wilson, 722 Silvermine Rd., New Canaan, Conn. 06840

[21] Appl. No.: 569,834

[22] Filed: Aug. 20, 1990

[51] Int. Cl.[5] ..... B30B 15/02

[52] U.S. Cl. ..... 100/221; 100/226; 100/240; 100/245; 100/266

[58] Field of Search ..... 100/211, 221, 240, 245-248, 100/265, 102, 226, 53, 260, 266, 267, 269 B, 278, 295; 220/336, 246, 264, 333, 670, 350, 909, 8, 288; 222/286.5

[56] References Cited

U.S. PATENT DOCUMENTS

| | | | |
|---|---|---|---|
| 1,372,190 | 3/1921 | Randall et al. | 100/211 |
| 1,628,850 | 5/1927 | Klein | 100/240 |
| 2,392,604 | 1/1946 | Mallory | 100/266 |
| 2,685,316 | 8/1954 | Krasno | 220/288 |
| 2,824,438 | 2/1958 | Candor | 100/211 |
| 3,478,909 | 11/1969 | Charles | 100/226 |
| 3,539,070 | 11/1970 | Dunlea | 220/8 |
| 3,550,528 | 12/1970 | O'Neill | 100/211 |
| 3,744,409 | 7/1973 | Bradbury, II | 100/265 |
| 3,835,769 | 9/1974 | Peterson | 100/53 |
| 3,863,561 | 2/1975 | Karls | 100/221 |
| 3,863,563 | 2/1975 | Popeil | 100/245 |
| 3,899,967 | 8/1975 | Powers | 100/211 |
| 3,919,932 | 11/1975 | Basuino | 100/266 |
| 4,337,105 | 6/1982 | Stachiw et al. | 100/211 |
| 4,826,045 | 5/1989 | Price et al. | 222/386.5 |
| 4,886,189 | 12/1989 | Vanderjagt | 222/386.5 |
| 5,033,375 | 7/1991 | Reeves | 100/265 |

FOREIGN PATENT DOCUMENTS

| | | | |
|---|---|---|---|
| 0147009 | 8/1902 | Fed. Rep. of Germany | 100/265 |

*Primary Examiner*—Harvey C. Hornsby
*Assistant Examiner*—James F. Hook
*Attorney, Agent, or Firm*—Haynes N. Johnson

[57] ABSTRACT

A trash container having a base and sides, at least a portion of the sides being formed of resilient horizontal pleated material throughout the circumference thereof, and a plunger fitting within the trash container and having a horizontal cross-section conforming to the internal horizontal cross-section of the trash container, the plunger including lips extending about the periphery thereof and shaped and dimensioned to fit over the upper edges of the sides. Alternatively, the top of the container may be used as a plunger. Pressure on the plunger will cause the sides to compress the pleated material, permitting the plunger to be pressed downwardly on the trash and compacting it. In a modification, the sides are rigid and the resilient pleated material is in the top of the container. The pleated or other resilient material has a memory and, so, will return to its original shape after pressure is removed.

14 Claims, 5 Drawing Sheets

1
2
3
4
5
6
7
8
9
10
11
27
25

9
25
19
35
4

33
17
9
11
15
27
25

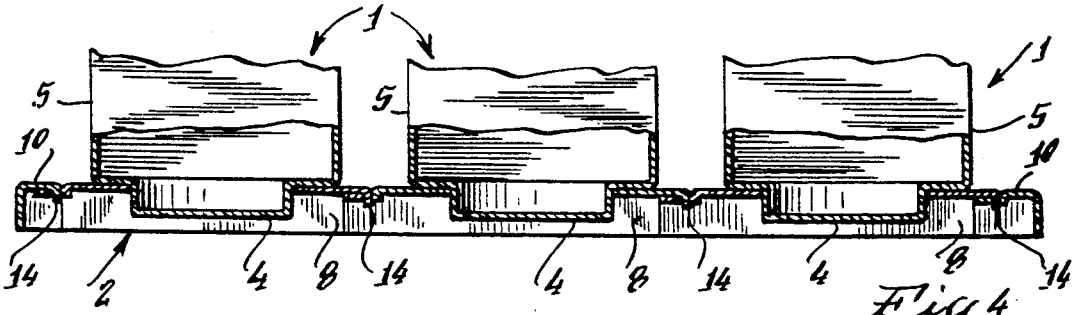
Fig. 4.
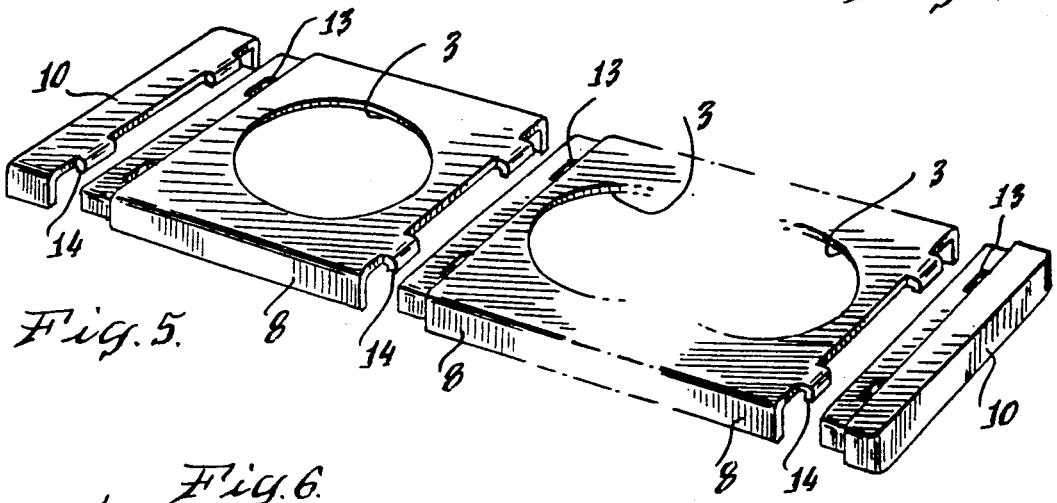
Fig. 5.
Fig. 6.
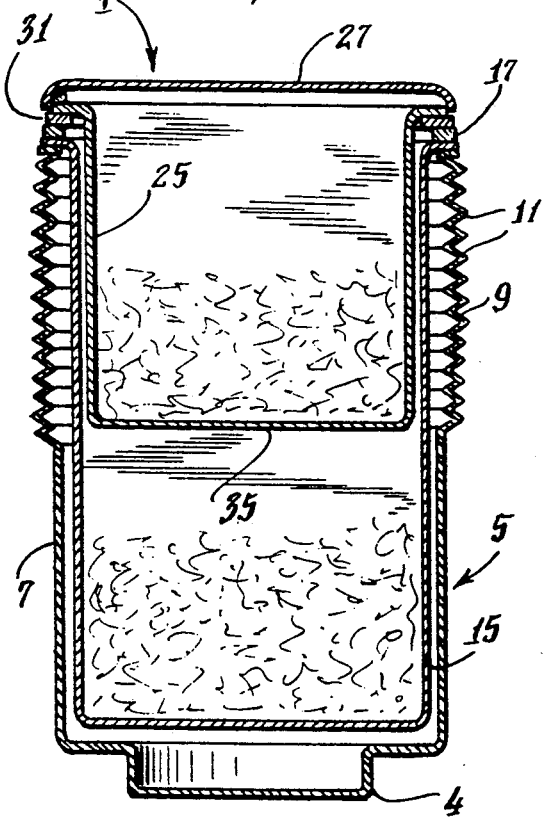
Fig. 7.
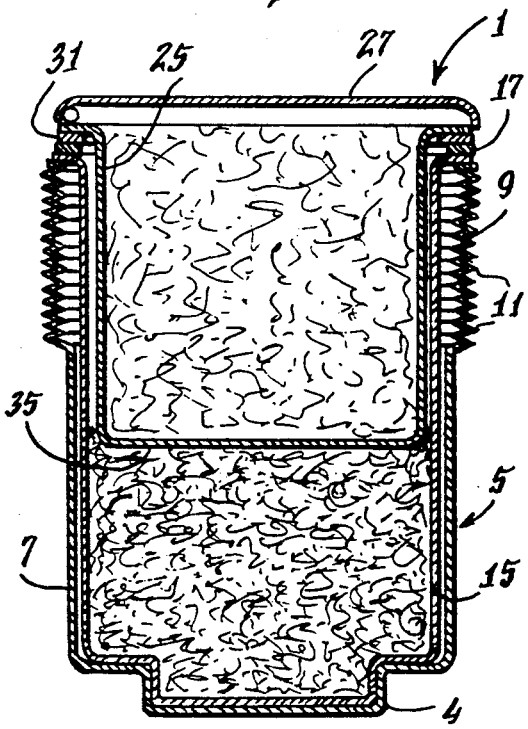

TRASH AND GARBAGE COMPACTING SYSTEMS

FIELD OF THE INVENTION

This invention relates to an inexpensive system for collecting and compacting trash and garbage. Although the system is primarily for the home, it is also ideal for application where trash collection space is limited, such as on an airplane, in a boat, in a car, or in a recreational vehicle. Being able to be modular, it is adaptable for sorting trash into various categories, such as paper, plastic, and glass, prior to disposal.

BACKGROUND OF THE INVENTION

Many systems have been developed for collecting and compressing trash. However, most of them are motor driven, and, so, expensive, noisy, and large. Being designed to crush or compress everything put into them, they have more power than is required for most purposes. Those that are not motor driven are either primarily aimed at can crushing alone or, if for general trash collection, they are inefficient and costly. The size and expense of motorized systems makes it impractical to have multiple units so that trash can be sorted.

Our system is simple and very easy to operate manually. It is quiet, effective, efficient, and easy to manufacture (can be made of plastic). Importantly, it is made to encourage the user to sort trash and garbage for recycling because it allows for multiple units that can compress such things as paper, boxes, plastic bottles, and packaging materials, thus even making it easier to store trash in less space, and even reducing the frequency with which it must be taken to a collection site.

BRIEF SUMMARY OF THE INVENTION

Our system provides trash containers to receive sorted trash. One such container might receive paper products, and another, plastic materials. Each trash container carries an upper covered garbage container, fitting within a larger, lower, compressible trash receptacle and being supported in position by lips which fit over the upper edge of the lower trash receptacle. The upper container may be used for wet garbage and is about half the height of the larger receptacle.

In one embodiment the lower portion of the sidewalls of the larger, compressible trash container may be of rigid construction, and the upper portion may be formed of resilient, accordion pleated material with the folds of the pleats running horizontally. Therefore, the upper portion, which is normally extended, can be compressed. The pleated material has a memory and, after being compressed and then released, will return to its original shape. In other embodiments the container will be entirely pleated or formed with pleats running at an angle.

When one wishes to dispose of trash, he removes the upper wet garbage container, deposits the sorted trash in the lower container, replaces the upper container, and presses down on it. This can be hand or foot pressure or he can sit on its top, providing the full weight of his body. The bottom of the upper, wet garbage container acts as a plunger, pressing down on the trash, and compacting it. After the downward pressure is removed, the lower container rebounds to its original height. This process can be repeated every time trash is deposited, or be done only as the trash container becomes full.

Alternatively, the lower container can have stiff sides and carry a top which has peripheral accordion pleats surrounding a central plunger. In this instance, the pleats are normally close together. By pressing down on the top, the pleats expand and the plunger moves downwardly to compact the trash. Upon release, the pleats contract, returning the top to its normal configuration.

One need not use an actual plunger, if not desired, and the inner surface of the top can act as a plunger means.

As can be seen, in each type there is a provision for relative vertical motion between the top or upper container and the bottom of the lower container, while the containers are closed, to compact the contained trash, coupled with sufficient resiliency (memory) to return the units to their normal shape after the downward pressure is removed. This resiliency can be achieved by pleating, or simply by using a material which is itself compressible, but having memory so it will return to its original shape after pressure is removed.

The system is modular in that,if one wishes to sort various types of trash, a series of these containers can be used, with a base adapted to hold them side by side. In this instance one container might be used for paper, another for plastic, etc. The upper "plunger" container can be used for wet garbage or for essentially non-compressible material, such as cans and bottles. There need not always be an upper plunger container, in which instance the inner surface of the top acts as a plunger.

DESCRIPTION OF THE DRAWINGS

FIG. 4 is a vertical section, taken on line 4—4 of FIG. 1, showing the way the bases of the containers fit within openings in the supporting base. It will be noted that the supporting base has been formed of three sections interlocked together.

FIG. 5 is an exploded perspective view showing the interlocking of sections of the supporting base.

FIG. 6 is a vertical section, taken on line 6—6 of the central container of FIG. 1. It is in its normal, uncompressed condition.

FIG. 7 is similar to FIG. 6 except that the container is now being compressed by weight exerted on its top. As can be seen, the bottom of the upper garbage container, acting as a plunger, is compressing trash carried by the lower container. There is relative vertical movement between the top and the bottom of the unit during compaction.

DETAILED DESCRIPTION OF THE INVENTION

Our compaction system enables consumers to more easily compact trash in the everyday process of collecting, sorting, and storing it within the home or garage. By providing hand or foot pressure to the compacting container or top, consumers can easily store more trash in less space, thereby facilitating separation of trash and even reducing the frequency with which it must be taken to a collection site.

Our system works because we provide for relative vertical movement between the top of the unit (which can itself be a container) and the bottom of the unit. Thus, downward force can be applied on the top to compact that trash resting on the bottom.

This provision for relative vertical movement can be done in any desired manner. We prefer using accordion pleated material which can be either more tightly closed or stretched during compaction. If the pleats are peripheral to the lower container and integral with it, pressing downwardly on the upper section of the unit will compress the pleats and compact trash. If the pleats are integral with the top, a plunger in the top can be pressed, extending the pleats, downwardly to compact the trash. In the first instance the accordion pleated material has been molded with memory that returns it to the extended/open position. In the second instance, the material is molded with memory that returns the pleats to the closed position.

As an alternative to pleats, one could use a material for the sides which is compressible in the vertical direction and which has a memory such that, after pressure is removed, will extend to its original shape. Or, if the resiliency is in the top, one would use a resilient material which could be stretched and thereafter return to its original shape.

Figure 1:
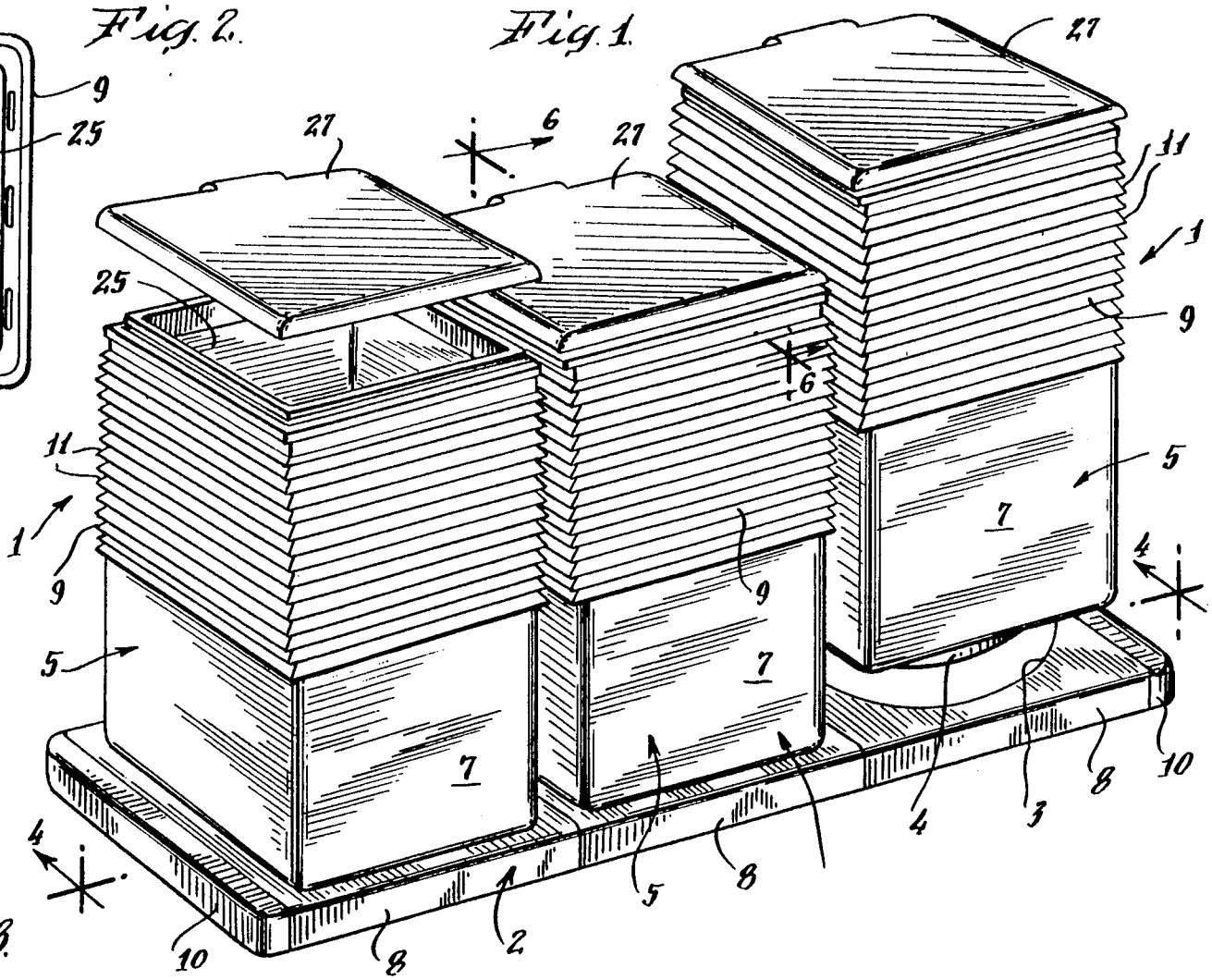
FIG. 1 is a perspective view of a bank of three of our containers, having a generally square cross-section. They are mounted on a base which interfits with the bottom of the units to hold them in place. For purposes of illustration, the left-hand container is a partially exploded view, showing the structure of the upper garbage container; the center container appears normally; and the right-hand container is shown held above the supporting base to show how the containers fit within the supporting base. Normally, all three would appear like the center one.
Figure 2:
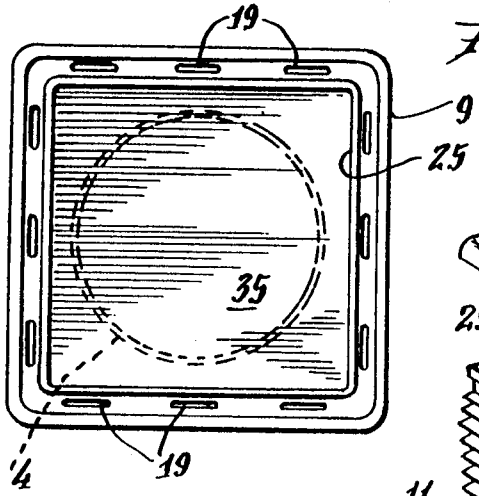
FIG. 2 is a top plan view of a single square trash container, such as one of those of FIG. 1, with the upper garbage container removed.

FIG. 1 shows a three-unit system with three containers 1. This could be used, for example, when sorting trash into three different types. Each container 1 is made up of a lower trash container 5 and an inner garbage container 25.

In this, our first embodiment, the lower portion 7 of the sidewalls of the trash container 1 may be of rigid construction, and the upper portion 9 be formed of resilient, accordion material. The upper portion, which is normally extended, can be compressed downwardly. When one wishes to dispose of trash, he removes the lid, which has some depth so that it extends down into trash container 5, forming a plunger-like structure, deposits the sorted trash in the container, replaces the lid, and presses down on it. This can be down by hand or foot pressure or by sitting on it. The bottom of the lid acts as a plunger, pressing down the trash and compressing it. When pressure is released, the container then rebounds to its original height due to the resilient material and its memory.

In FIG. 1 the center container 1 is shown in its normal, uncompressed mode. The right-hand container is shown as it would be when compressing trash, by weight being applied to the top. The left-hand container is shown in an exploded view. It has been raised slightly off supporting base 2 to show the opening 3 in the base to receive bottom 4 of the container; and the inner garbage container 25 has been opened and raised above trash container 5.

Supporting base 2 may be formed of separate individual base sections 8, interlocked together, and with end piece 10 (FIGS. 1 and 4). This permits the base to be adapted to any number of containers, depending upon the number needed and the extent to which trash is to be sorted. The sections and end piece are secured together with slots 13 and lugs 14.

The trash container 5 may be generally rectangular or round in horizontal cross-section. Its lower section 7 is smooth and rigid and has a substantially uniform cross-section throughout its length. Its upper section 9 is pleated with accordion folds 11, the inner horizontal dimension of which is at least equal to or greater than that of the corresponding lower section 7. The accordion folds are made of resilient material so that, after being compressed, the material will spring back to its original extended shape.

Figure 10:
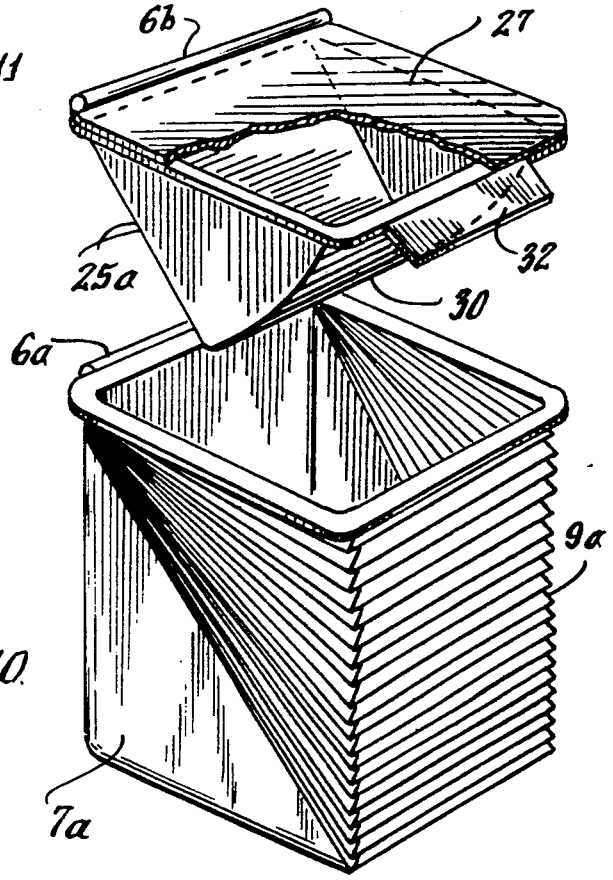
FIG. 10 is an exploded perspective view of a modification in which the folds are not parallel, but are fan-shaped leading to a pivot axis.
Figure 11:
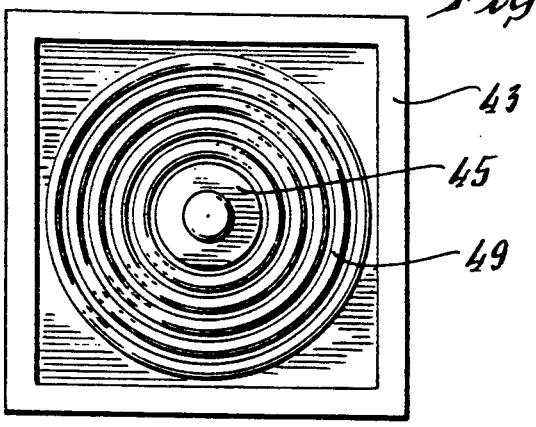
FIG. 11 is a plan view of another modification in which the accordion pleats are in the top, surrounding a plunger. This modification also allows for relative vertical motion between the plunger in the top portion and the bottom of the larger container. Here, the normal position of the pleats is to be tightly folded together, and the pleats are stretched when compacting is taking place.
Figure 13:
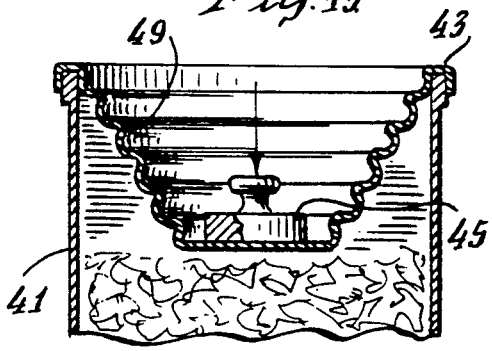
FIGS. 12 to 14 are vertical sections of the modification of FIG. 11, showing the pleats in varying degrees of extension.
Figure 12:
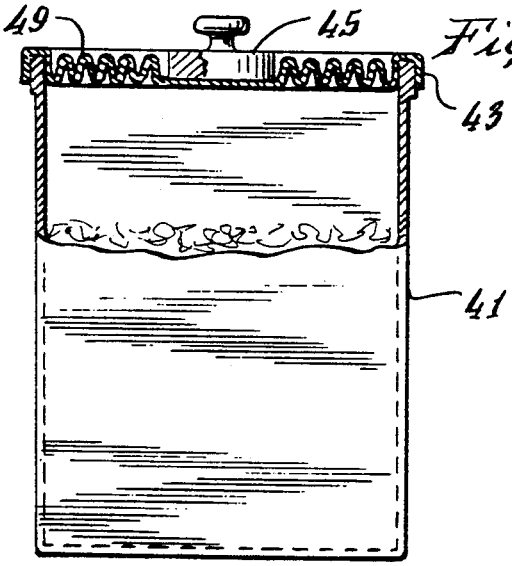

Normally, upper section 9 would be of about the same length or slightly shorter than lower section 7, but this can be varied to suit the needs of the designer. However, at least a portion of trash container 5 has folds 11 or uses a material which can be compressed in its plane. Usually these folds will encompass the entire perimeter, but variations, such as shown in FIG. 10 are also possible.

Note that, when only a portion 9 is pleated, the accordion folded sides 9 extend outwardly of the unit and do not extend into the area occupied by the bag 15. That is, the horizontal dimension of the inside of folded section 9 is at least as large as that of the corresponding dimension of section 7 (See FIGS. 3 and 6).

Trash container 5 may be made of polyethylene, ABS, or any other satisfactory plastic. It can be made by most normal production means, such as blow molding, rotational molding, injection molding and the like. The lower section 7 should be rigid. The folds 11 of the upper section 9 should have enough rigidity to maintain the upper section in its normal extended shape, such as the center unit in FIG. 1. Folds that are about an inch apart and about one inch deep, in a container with a horizontal dimension of 12 to 15 inches work satisfactorily. Accordion-pleated air conduit material, available commercially, can often be used. A few air holes 12 may be placed in the pleated folds 11 for release of air during compression; they are best placed on the underneath folds where they are less visible.

Downward force, exerted on the top of trash container 5, will cause the folds 11 to compress, shortening the total length of trash container 5. About 10 to 15 pounds force is all that is required for the above-described container.

Trash container 5 has a paper trash bag 15 securely mounted in it (FIGS. 3 and 6), so that it will maintain its position when container 5 is compressed. It may be mounted by any desired means; a retaining ring 17 fitting within and on top of the upper edge of container 5 works satisfactorily. If desired, ring 17 may include a series of slots 19 to allow air to escape from the space between the bag 15 and container 5 when the container is compressed.

Upper garbage container 25 fits within the upper portion of trash container 5. It is made of rigid plastic material and has a horizontal cross-section of the same configuration as that of trash container 5, and its outer dimensions are just slightly smaller, about one-half inch to one inch, than the inner dimensions of the lower section 7 of the trash container. Container 25 has a hinged lid 27 and outwardly-extending lips which fit over the upper edges of trash container 5. These lips hold it in position within container 5 and are also used to transmit compressive force to the top of container 5. A bag may be fitted within garbage container 25 and, if desired, held in place with a retaining ring 31. Though we have referred to the upper container 25 as a garbage container, it may be used to hold other items than garbage, for example, cleaning materials. This is especially so when several of our modular units are used, for the user may not wish to hold garbage in each of them.

Container 25 is used as a plunger to compress trash, and its bottom surface may be referred to as plunger 35.

Figure 3:
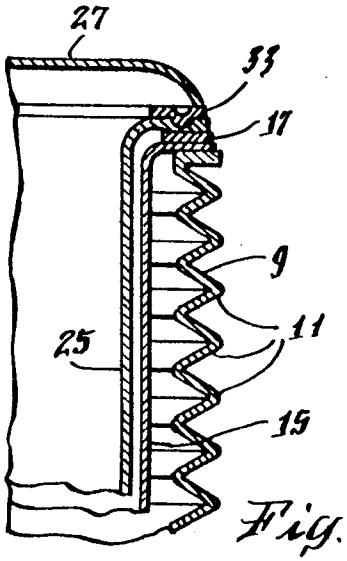
FIG. 3 is a partial vertical section of the upper portion of one of our containers, showing how the parts of one container interfit.

FIG. 3 gives is a partial section of the top of a side, showing more detail. The upper section 9 is shown with folds 11. A bag 15 is inside with its top edge being held in position by retaining ring 15. The lip 33 of the upper garbage container 25 rests on ring 17, and the container is covered by lid 27.

FIGS. 4 and 5 show the base 2, adapted to hold several containers 1. It is formed of individual base sections 8 and end pieces 10 interlocked with lugs or pins 14 on one section fitting into complementary slots 13 on the adjacent section.

The use of our system is shown in FIGS. 6 and 7. Garbage container 25 fits within the top portion of trash container 5, being held in place by lips 31 which fit on the top edges of trash container 5. "Wet" garbage is disposed of by opening the lid 27 and dropping it in.

Trash, such as paper, is placed in trash container 5 by removing garbage container 25, which acts as a top for container 5, and putting it in; container 25 is then replaced. At that time, or periodically, force is exerted on the top 27 of container 25 to compress the accordion folds 11. This force can be hand pressure, or the user can simply sit on the top 27. Compression of the folds means that the bottom surface of container 25, the plunger 35, will press against the trash and, so, compress it.

Since the trash will have been previously sorted, incompressible or difficultly compressed material will not be in container 5, and, consequently, the material to be compressed can be compressed with the small forces used. The need for a heavy, motor-powered unit has been obviated.

By using several modules of our system, mounted side-by-side on supporting base 2, different trash containers 5 may be used for different, sorted types of trash. Also, if desired, some of the upper containers 25 can be used for incompressible, but sorted material, such as glass bottles or cans.

Figure 8:
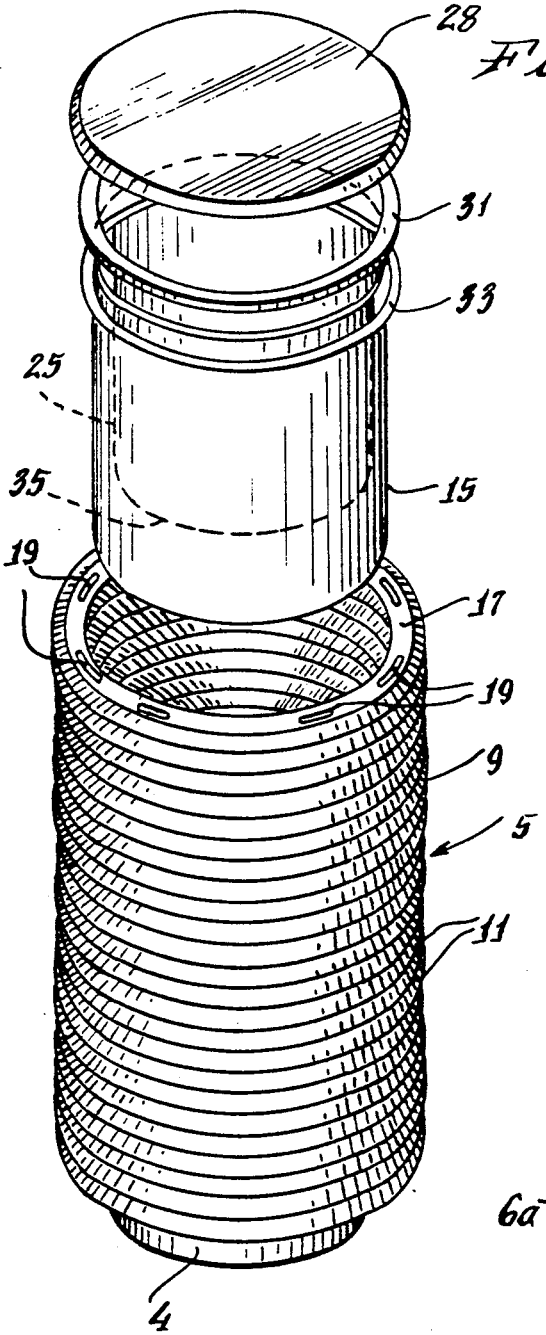
FIG. 8 is an exploded perspective view of a container which has a round cross-section.

FIG. 8 shows a trash and garbage container unit similar to that of FIG. 1. Here, however, the unit is circular in cross-section. It works on the same principal as the square cross-section units, except that, because of the shape, the top 28 is preferably removable rather than hinged. Note that in this modification, as is also possible in units with square cross-section, the folds run the entire length of trash container 5.

Figure 9:
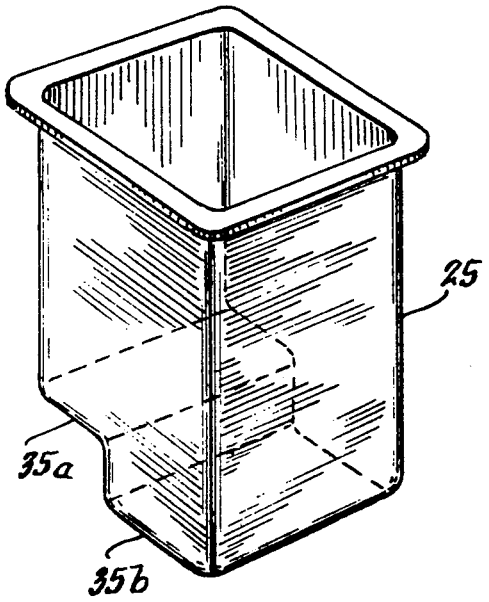
FIG. 9 is a modified inner garbage container, with its lowermost portion having two levels, so that trash compression takes place only on one side at a time, thus providing greater compaction pressure. The inner container is rotated 180° between compressions, so that the trash on each side can be compressed.

FIG. 9 shows a modification which can be made to the bottom 35 of the upper garbage container 25. Bottom 35, which acts as a plunger, is divided into two sections, upper section **35*a* and lower section 35*b*. Since the lower section presses against the trash, more pressure can be applied. The pressure is first applied with the plunger 35** in one position; then the plunger is rotated 180°; and pressure applied again.

FIG. 10 shows a further modification. Here the resilient folds **9*a* in trash container 5*a* are not parallel to one another, but are fan-shaped and fold about a pivot point or apex. Corresponding fan-shaped folds are on opposite sides of the container. The remaining stiff lower section 7*a* is generally triangular in cross-section. Inner garbage container 25*a* has a pie-shaped cross-section with arcuate portion 30. It can be secured to trash container 5*a* with a releasable hinge 6*a* and 6*b* positioned running between the apices of the fan-shaped folds 9*a*, and has a hinged top 27. A foot pedal 32 is positioned at the opposite edge of container 5*a***.

In using the modification of FIG. 10 foot pedal 32 can be used as a handle to lift garbage container **25*a* so trash can be dropped into trash container 5*a*. Container 25*a* is then returned to its normal position and foot pressure applied to pedal 32** to compress the trash.

Additional modifications of our invention are shown in FIGS. 11 to 14 and 15 and 16. They both use the same principle as above, i.e., provision for resilient vertical movement between a top plunger and the bottom of a trash container. Here, however, resiliency is achieved within the container lid; and the pleats are normally closed and are stretched by downward force to compress the trash.

Figure 14:
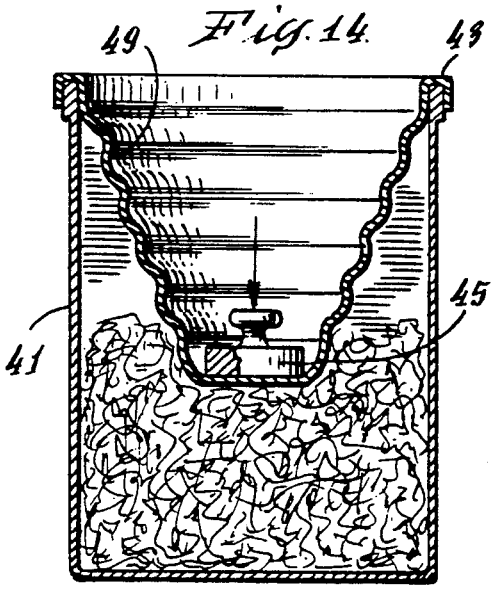

The lower container 41, here, is made of rigid material, having no folds. The top 43 has a center plunger 45 carried by surrounding pleats or folds 49. The pleats in the modification of FIGS. 11 to 14 have been formed so as to be normally compressed together concentrically to form a generally planar top. The top is removed to deposit trash, and then the trash is compressed by pushing down on plunger 45, as shown in FIG. 14.

Figure 15:
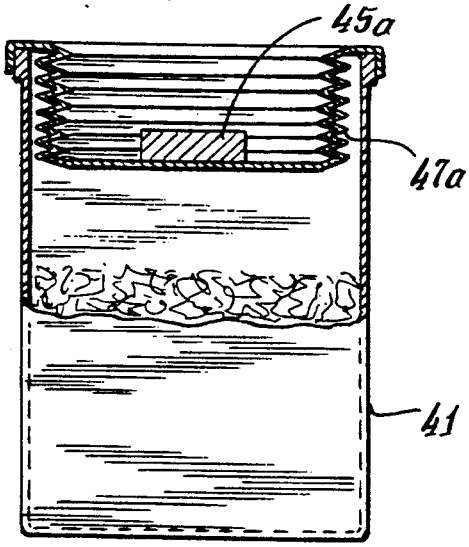
FIGS. 15 and 16 show a modification with the pleats in the top, like that of FIG. 11, except the plunger area encompasses most of the horizontal cross-section of the unit.
Figure 16:
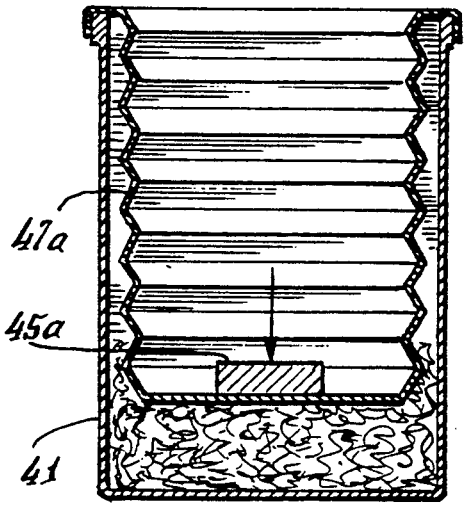

The structure of FIGS. 15 and 16 is similar, except, here, the compressed folds **47*a* are vertically arranged, permitting the plunger 45*a* to more nearly be the full cross-sectional area of the lower container 41**.

The structure of FIGS. 11 to 14 is a square trash container; that of FIGS. 15 and 16 is a square container, with the pleats being generally one above the other. The pleat structure of the FIGS. 11 to 14 can, of course, be used in a round container; and the pleat structure of FIGS. 15 and 16, used in a square container.

Figure 17:
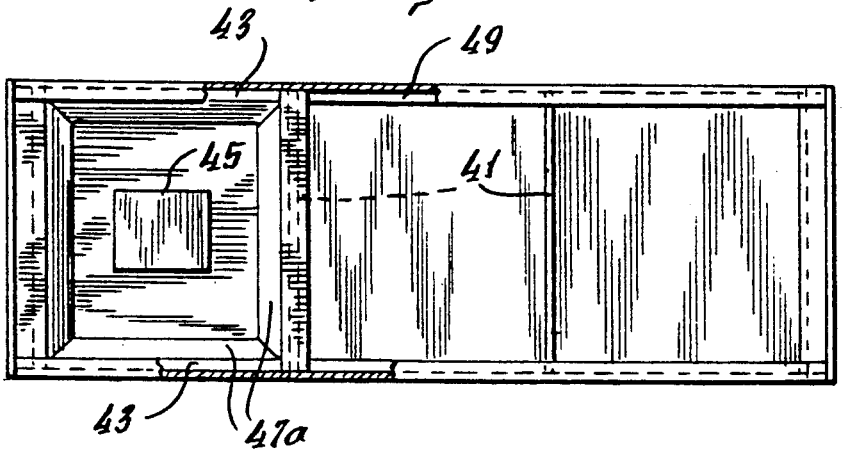
FIGS. 17 and 18 are a plan view and a vertical section of a multiple-bin structure using the top of FIG. 15. Here a single top slides on rails across the upper ends of several bins and, so, can be used to successively compress the trash in those bins.
Figure 18:
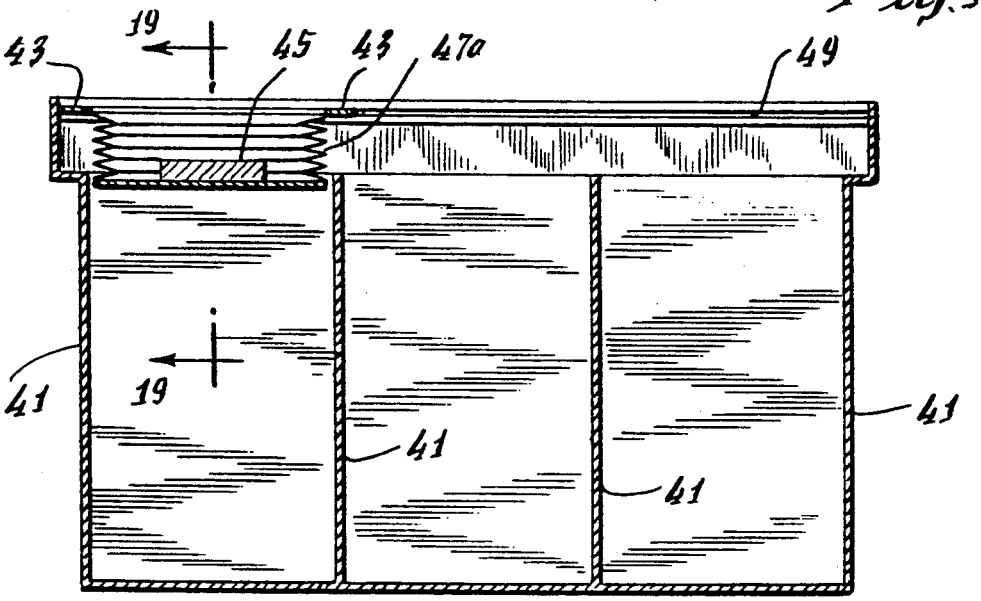
Figure 19:
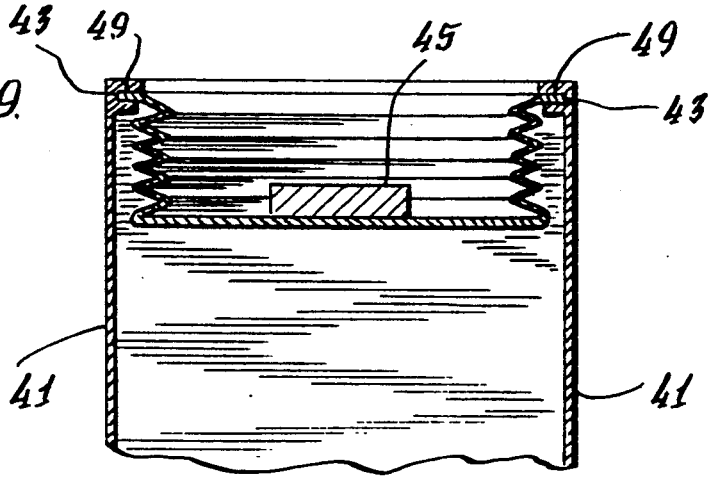
FIG. 19 is a vertical section, taken on lines 19—19 of FIG. 18.

If one wishes to sort various kinds of trash, a series of rigid containers 41 can be placed side by side, as shown in FIGS. 17 to 19. A single top 43, carried by rails 49, could slide across the top of the containers to be used for compressing the trash. The top 43 would slide in rails 49 so as to be positioned over one of the containers and, so, be used to compress the trash in that container.

We claim:

1. A system for containing and compacting trash, adapted for compaction without the use of mechanical force, said system including at least one trash container having sides, a bottom, and a top, said container having vent means to permit air to escape during compaction of said trash, said top including plunger means extending downwardly into said container and slidingly movable downwardly with respect to said sides, self-sustaining resilient means formed throughout the circumference thereof of said container, said resilient means normally holding said plunger means within said container but removed from said bottom, permitting said plunger means to move downwardly and into said container towards said bottom when downward pressure of body weight is applied to said plunger means, and causing said plunger means to return to its original position removed from said bottom when said downward pressure is removed, whereby application of said downward pressure will cause said trash to be compacted between said plunger and said bottom.

2. A system as set forth in claim 1 in which said resilient means is formed in said sides of said container, about the entire periphery thereof, whereby said downward pressure will cause said sides to be reduced in height as said downward pressure is applied.

3. A system as set forth in claim 2 in which said resilient means is a horizontal accordion fold which is normally extended.

4. A system as set forth in claim 1 in which said resilient means is a horizontal accordion fold on one of said sides and is a pie-shaped accordion fold on the adjacent said sides.

5. A system as set forth in claim 1 in which said resilient means is formed in said top and surrounds said plunger.

6. A system as set forth in claim 5 in which said resilient means is an accordion fold which is normally compacted, whereby said downward pressure extends said folds and allows said plunger to move towards said bottom, thereby compressing said trash.

7. A system as set forth in claim 1 in which said resilient means is formed in a portion of said sides of said container and the remainder of said sides is formed of rigid material.

8. A container for holding trash and for compressing said trash, said container including a trash container, said trash container having a base and self-sustaining sides, said sides having upper edges, said trash container having vent means to permit air to escape during compaction of said trash, at least a portion of said sides being formed of resilient horizontal pleated material throughout the circumference thereof, and at least a portion of said sides being of rigid material to form self-sustaining sides, said portions together forming the totality of said sides, said resilient material being compressible by the force of body weight, and rigid plunger means fitting within said sides of said trash container and having a horizontal cross-section conforming to the internal horizontal cross-section of said portion, said plunger means being slidable downwardly with respect to said self-sustaining sides, said plunger means including lips extending about the periphery thereof and shaped and dimensioned to fit over the upper edges of said sides, whereby said trash may be held in said trash container and pressure on said plunger will cause said sides to compress at said pleated material, permitting said plunger to be pressed downwardly on said trash.

9. A container as set forth in claim 8 in which said portion of said sides made up of said pleated material is the upper portion of said sides and the remainder of said sides have horizontal dimensions at least as great as those of said pleated material.

10. A container as set forth in claim 8 in which said plunger is hollow and has a top, whereby said plunger can be used as a garbage container.

11. A container as set forth in claim 8 having a rectangular horizontal cross-section.

12. A container for holding trash and for compressing the trash, said container including a lower container, said lower container having a base and sides and no top, said sides being self-sustaining and being formed of a lower portion and of an upper portion, one of said portions being rigid and the other of said portions being formed of horizontal pleats throughout the circumference thereof, said portions having similar horizontal cross-sections, plunger means extending into said upper portion, sliceable downwardly with respect to said upper portion, and having a horizontal cross-section conforming to the said horizontal cross-section of said portions, the upper part of said plunger means interengaging with the upper edge of said upper portion, said horizontal pleats being compressible upon the application of body weight to said plunger, and said container having vent means to permit air to escape during compaction of said trash, whereby trash may be held and compressed in said lower portion.

13. A modular unit for collecting trash and garbage, said unit including a base, a plurality of containers mounted on said base, at least one of said containers including a lower trash container and an upper garbage container fitted within the upper portion of said trash container and resting on the upper edges thereof, at least a portion of the sides of said lower trash container being resiliently and vertically compressible upon the application of body weight and for the full circumference thereof, whereby downward force on said garbage container will compress the sides of said trash container allowing the bottom of said garbage container to press against trash carried by said trash container.

14. A modular unit as set forth in claim 13 in which said resiliently compressible portion is made of pleated material.

* * * * *